United States Patent [19]

Nussbaumer

[11] Patent Number: 4,673,312

[45] Date of Patent: Jun. 16, 1987

[54] METHOD AND APPARATUS FOR THE UNDERGROUND INSTALLATION OF PIPELINES

[75] Inventor: Manfred Nussbaumer, Leonberg, Fed. Rep. of Germany

[73] Assignee: Ed. Züblin Aktiengesellschaft, Stuttgart, Fed. Rep. of Germany

[21] Appl. No.: 738,029

[22] Filed: May 24, 1985

[30] Foreign Application Priority Data

May 25, 1984 [DE] Fed. Rep. of Germany ..... 3419517

[51] Int. Cl.[4] ..... F16L 1/02; E21B 7/18; E21D 9/10

[52] U.S. Cl. ..... 405/184; 405/134; 405/138; 175/67

[58] Field of Search ..... 405/138, 141–143, 405/146, 150, 154, 163, 184, 132, 134, 135, 155, 247, 248; 254/29 R; 175/62, 65, 67, 92

[56] References Cited

U.S. PATENT DOCUMENTS

| | | | |
|---|---|---|---|
| 748,809 | 1/1904 | Stone | 405/143 |
| 2,325,565 | 7/1943 | Williams | 405/184 |
| 2,783,972 | 3/1967 | Fehlmann | 175/67 X |
| 3,529,682 | 9/1970 | Coyne et al. | 405/184 X |
| 3,589,135 | 6/1971 | Ede | 405/184 |
| 3,730,283 | 5/1973 | Kostylev et al. | 175/62 X |
| 3,839,875 | 10/1974 | Matsushita | 175/67 X |
| 3,894,402 | 7/1975 | Cherrington | 405/184 |
| 4,319,648 | 3/1982 | Cherrington | 405/184 X |
| 4,403,664 | 9/1983 | Sullinger | 175/62 X |
| 4,487,525 | 12/1984 | Shiotsubo et al. | 405/184 |

FOREIGN PATENT DOCUMENTS

| | | | |
|---|---|---|---|
| 3047161 | 6/1982 | Fed. Rep. of Germany | 405/141 |
| 1083322 | 9/1967 | United Kingdom | 405/141 |
| 610938 | 6/1978 | U.S.S.R. | 175/62 |

*Primary Examiner*—Cornelius J. Husar
*Assistant Examiner*—Nancy J. Stodola
*Attorney, Agent, or Firm*—Becker & Becker, Inc.

[57] ABSTRACT

A method and apparatus for the underground installation of pipelines. The underground installation of pipelines is carried out by driving pipe sections into the ground. The earth is loosened at the driving face via a liquid jet, and the excess earth is transported away from the removal zone. Only so much of the earth that has been loosened and mixed with the liquid is removed, such that the removal zone is always completely filled with the earth-liquid mixture. The larger earth aggregates or obstructions in the ground are forced outwards. In this way, the driving face does not require any special support. A receiving device with entry orifices for the earth-liquid mixture is located behind a nozzle head provided for discharging the liquid jet. A sluice serves to pass the mixture into a removal pipe in a controlled manner.

37 Claims, 18 Drawing Figures

METHOD AND APPARATUS FOR THE UNDERGROUND INSTALLATION OF PIPELINES

BACKGROUND OF THE INVENTION

1. Field of the Invention

The present invention relates to a method for the underground installation of pipelines, which preferably have impassable cross sections, by driving pipe sections into the ground, with the earth at the driving face being loosened by being broken up, pulverized, or bored by means of a liquid jet ejected or discharged from a nozzle head at high pressure and high speed; the excess earth is transported backwards from a removal zone between the driving face and a removal device through the pipe for removal or treatment. The present invention also relates to an apparatus for implementing such a method. The apparatus has at least one driving unit for the pipe, and a machine unit which is traversable in the pipe and has at least one nozzle head for loosening the ground; the machine unit is connected by piping to supply and removal units and by cables to control devices, and has at least one removal pipe for conveying away the loosened earth.

2. Description of the Prior Art

The construction of pipelines having small, impassable cross-sectional diameters by the known driving method is finding increasing application. Starting from a driving station, pipe sections are driven forward by being pushed into the ground, with the earth at the head of the driving line being loosened by means of suitable machine units and being conveyed through the interior of the pipe to the access shaft, and from there to the earth's surface. The known methods for the construction of impassable pipelines are essentially capable of being steered, so that a certain directional accuracy can be adhered to.

The systems mentioned below for the installation of such pipelines are known, and to some extent have already been tried out in practice. In a Japanese system, known by the name Tele-Mole or Tele-Mouse, the machine unit for loosening the earth consists essentially of a boring head with a drive, and a shield unit, which are not separable and are driven into the ground ahead of the actual pipe sections and with the latter. The machine unit cannot be retracted through the driving line during the advance. A separate machine unit must be used for each different external pipe diameter.

A so-called horizontal boring device is also known, with which diameter ranges from 700 to 1000 mm can be driven with the same boring head drive. Only the boring head and the steel sleeve of the boring device have to be adjusted to the external diameter of the pipe. However, this boring device is also not retrievable through the driving line during driving.

Whereas with the heretofore known systems a steerable boring device with a boring head or a digging plate digs out the external diameter of the pipe directly in the ground, the so-called Iron Mole System works on the so-called widening principle. In this case, a steerable pilot head of small cross section on a tubular steel pipe, the so-called pilot pipe, is first driven up to the target shaft. This pilot bore-hole is then widened by means of a so-called widening stage to the final external diameter. In this case, the pilot pipe is recovered in sections in the target shaft. The system is suitable for external pipe diameters of 216 to 730 mm.

In the field of construction of impassable pipeline cross sections, the Hansemole System, a further development of the Tele-Mole System, is known as a more recent development. By means of a conical design of the digging plate, the external diameter of the pipe is supposed to be overlapped, and too-coarse grain forced outwards. At the same time, stones with a diameter of 13 to 15 cm are supposed to be fed inside to an incorporated crusher. A further development of the hydraulic shield for large diameters is the hydraulic jet shield, which has been specially developed for smaller diameters. Inside the shield sleeve the earth is loosened by jets directed towards the axis, and is pumped away. The hydraulic jet shield cannot, however, be retrieved during the driving operation.

Another known device uses a steel pipe articulated shield. In this system there are also two pipes driven instead of one. The overall construction time is therefore long, and the number of machine pipe elements held available for the various diameters is large. The steel pipe articulated shield does, however, offer the possibility of recovering the boring head and the boring drive at any point in the driving operation for the purpose of repair or maintenance work.

A further known driving system operates with exchangeable working tools. All of the working tools and drives are housed in a so-called inner shield which can be pulled back to the access shaft through the already driven pipeline on runners or wheels by means of steel cables.

All the above-mentioned driving systems for impassable pipelines are limited in their field of use, especially by the ground strength and the receivable maximum grain, the diameter of which, measured on the longer side, must not exceed 80 to 130 mm. In addition, it is generally necessary to use gravel crushers which pulverize the large grain from 80 to 130 mm down to about 20 to 30 mm, in order that the latter can be transported out by means of the hydraulic coveyer. None of the systems mentioned is capable of combining and satisfying all the requirements associated with the underground driving of pipelines having impassable cross sections between about 300 to about 1000 mm, and with the loosening process involving removal. These requirements are summarized as follows: During driving there must be the possibility of continuous positional measurement and directional correction of the driving line. The device must enable a depth-independent, low-settlement application in as many grounds as possible without ground-water lowering, and it must not be susceptible to failure in the presence of fairly large earth inclusions and obstructions in the pipe route. The machine unit must be able to be recovered at any time during the driving operation for the purpose of repair, maintenance, and the replacement or exchange of tools and machines. The units for loosening and transporting the earth should be mechanically rugged and simply require little maintenance and not be susceptible to repairs. Moreover, the device should be suitable for as wide a range as possible of inner and outer diameters of the pipeline, and should require only low investment and operating costs and the storage in stock of only a few system components. The pipeline should be statically secured. Finally, the device should have a high operating efficiency due to high driving speeds, and no double casing should be necessary.

It is an object of the present invention to provide a method and an apparatus with which it is possible to satisfy the above-mentioned requirements which have to be imposed on a steerable drive.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

The method of the present invention is characterized primarily in that only so much of the earth that has been loosened and mixed with the liquid of the jet is removed from the removal zone, such that the removal zone is always completely filled with the earth-liquid mixture; and in that larger earth aggregates or obstructions in the ground are forced outwards.

The apparatus of the present invention is characterized primarily in that at least one nozzle head is connected to the machine unit by means of an attachment device inside the pipe which is to be driven; in that a receiving device with entry orifices for the earth-liquid mixture is located behind the nozzle head, when viewed in the driving direction, for the purpose of receiving the excess earth-liquid mixture into a internal ante-chamber of the machine unit; and in that a sluice is provided for passing the earth-liquid mixture from the internal ante-chamber into the removal pipe in a controlled manner.

With the method according to the present invention, it is possible for the first time to drive a pipe with diameters preferably between about 700 to about 1000 mm into the ground with directional and target accuracy and, with relatively little expenditure on machinery, to loosen the ground with a recoverably or retractable machine unit, to force larger obstacles outwards, and to transport away the excess fine-grained earth inwards. Special support for the driving face by means of compressed air or bentonite suspensions is not necessary, because an appropriate pressure is exerted on the driving face by the removal zone, which is always completely filled. The method enables largely settlement-free driving and an additional positive effect for the stability of the pipeline with regard to the static loading capacity, without the need for an additional compressed air service or water drainage. The method is suitable for almost all soils, and promises to be a much less costly and less time-consuming application than the heretofore known methods and devices. The machine elements are simple, rugged, and less expensive, so that repair and maintenance work is reduced to a minimum.

Pursuant to one embodiment of the present invention, the machine unit may be provided with wheels, runners, chains, caterpillars, and the like, which are preferably adjustable roughly radially to the machine unit, so that it can travel in the pipe; furthermore, the machine unit can be locked in a given position in the pipe by at least one clamping device so as to transfer longitudinal forces and moments. The wheels, runners, chains, caterpillars, and the like can preferably be pressed against the inner wall of the pipe with at least one pressure mechanism so as to transfer longitudinal forces and moments.

Further features of the invention will be described subsequently.

DESCRIPTION OF PREFERRED EMBODIMENTS

Figure 1:
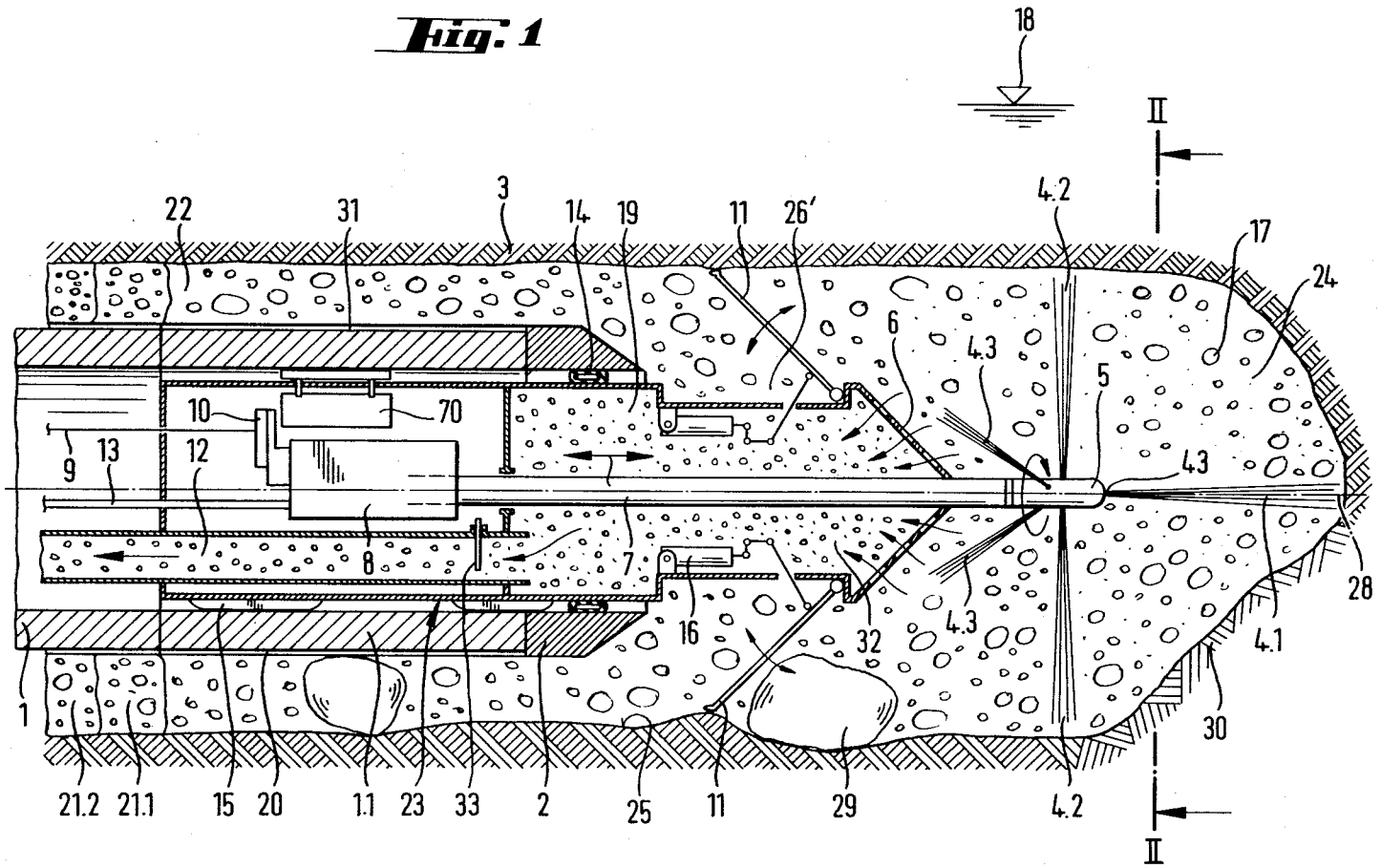
FIG. 1 is a diagrammatic representation, and a longitudinal cross section, of one embodiment of an apparatus according to the present invention for implementing the inventive method.
Figure 3:
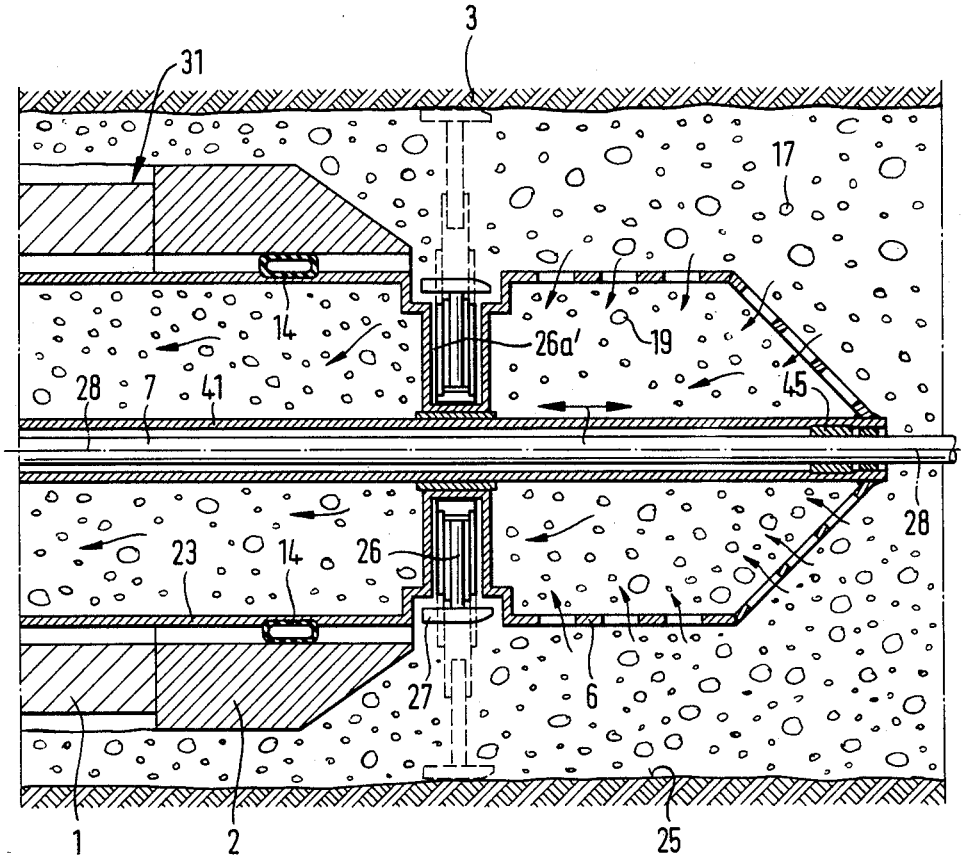
FIG. 3 is a cross section through the front area of a machine unit of a further embodiment of an apparatus according to the invention.
Figure 3A:
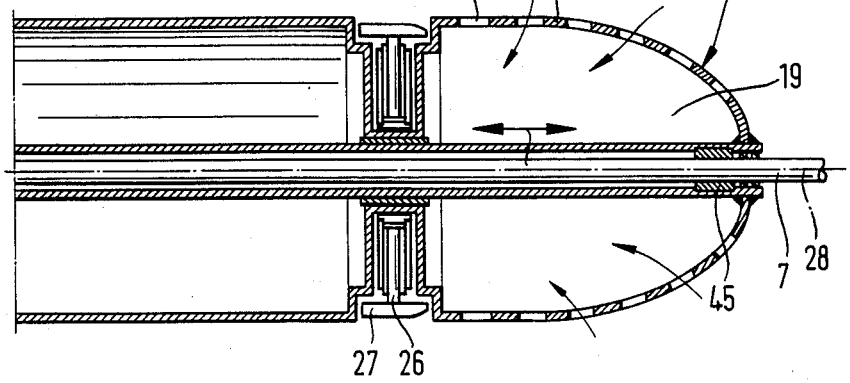
FIG. 3A is a longitudinal section through a further embodiment of a receiving sieve of the apparatus according to the invention.
Figure 3B:
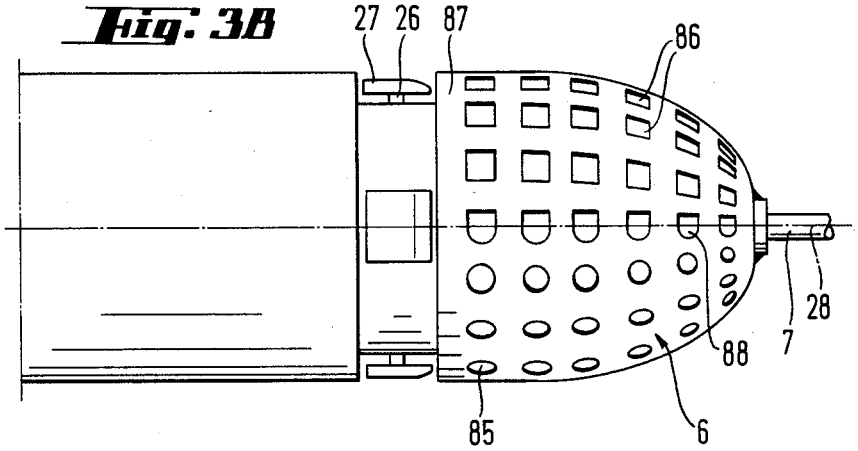
FIG. 3B is a side view of the receiving sieve according to FIG. 3A.

Referring now to the drawings in detail, the method is described with the aid of the device shown in FIG. 1. FIG. 1 shows a section through the front area of a pipe which is being driven, and through a machine unit 23 for loosening the solid ground 3 and for transporting away the excess earth material 19. The solid ground 3 is loosened at the driving face 30 by means of hydraulic jets 4, which are emitted at a high exit speed and under high pressure from a nozzle head 5 preferably rotating about the pipe axis 28. Depending on the type of earth to be encountered, the jet quantity, the exit speed, the nozzle pressure, and the jet direction are adjusted in such a way that the solid ground 3 is loosened in a radius equal to or preferably larger than the external diameter of a pipe 31. The hydraulic jets 4 are comprised, as a rule, of water, to which binding agents and/or other additives, such as for example bentonite or fine-grained quartz sand, can be added. The loosened earth aggregates mix with the jetted-in liquid and the additives to form a homogeneous earth-liquid suspension 17, which at the same time supports the driving face 30. The fine-grained earth components 19, which for example are less than 30 to 40 mm, pass during the driving operation through a conically shaped receiving sieve 6 into an internal ante-chamber 32 of the machine unit 23, and are then conveyed through a sluice 33 into a removal pipe 12. The receiving sieve 6 forms the front end, in the driving direction, of the machine unit 23. In the embodiment of FIGS. 1 and 3, the receiving sieve 6 has a conical shape. However, it may also comprise a dome-shaped steel plate 87 (FIGS. 3A–B). The entry orifices 85, 86 can be provided in combination in the steel plate 87. It can, however, also have square entry orifices 88, one edge of which is curved convexedly.

Figure 3C:
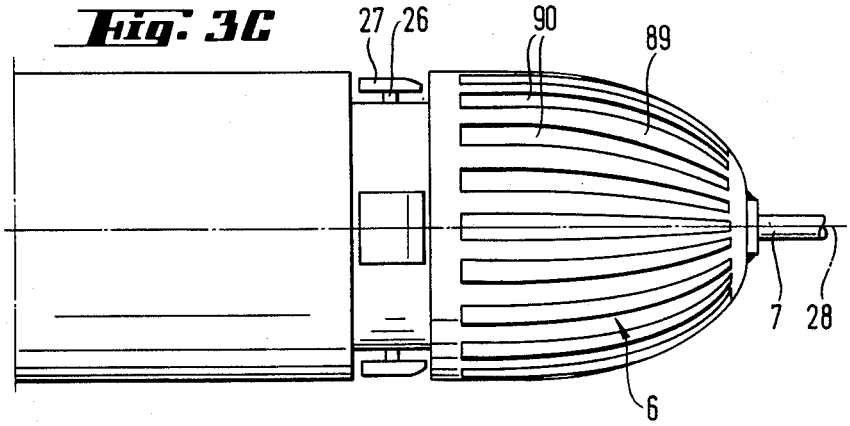
FIG. 3C is a side view of a further embodiment of a receiving sieve.

In the form of embodiment according to FIG. 3C, the receiving sieve 6 is formed by a rod lattice 89, between the rods of which slot-shaped entry orifices 90 are formed.

The nozzle head 5 sits on a guide rod 7 projecting concentrically out of the receiving sieve 6, said guide rod 7 extending to a drive 8 housed in the machine unit 23. The sluice 33 is a component part which narrows the cross section of the removal pipe 12, and which is adjusted in such a way that at any given time only so much of the earth-liquid suspension 17 is removed that the removal zone 24 is always completely filled with the earth-liquid suspension. Larger obstructions, such as boulders or stone fragments 29, are forced outwards from the conical receiving sieve 6 during driving, and are embedded between the pipe outer wall and the solid ground 3. With very large obstructions 29, a space for receiving the obstructions 29 which sink due to gravity in the earth-liquid suspension 17 can be created by intensified jetting of the lower edge 25 of the driving face so as to allow the obstructions 29 to be forced sideways.

Figure 9:
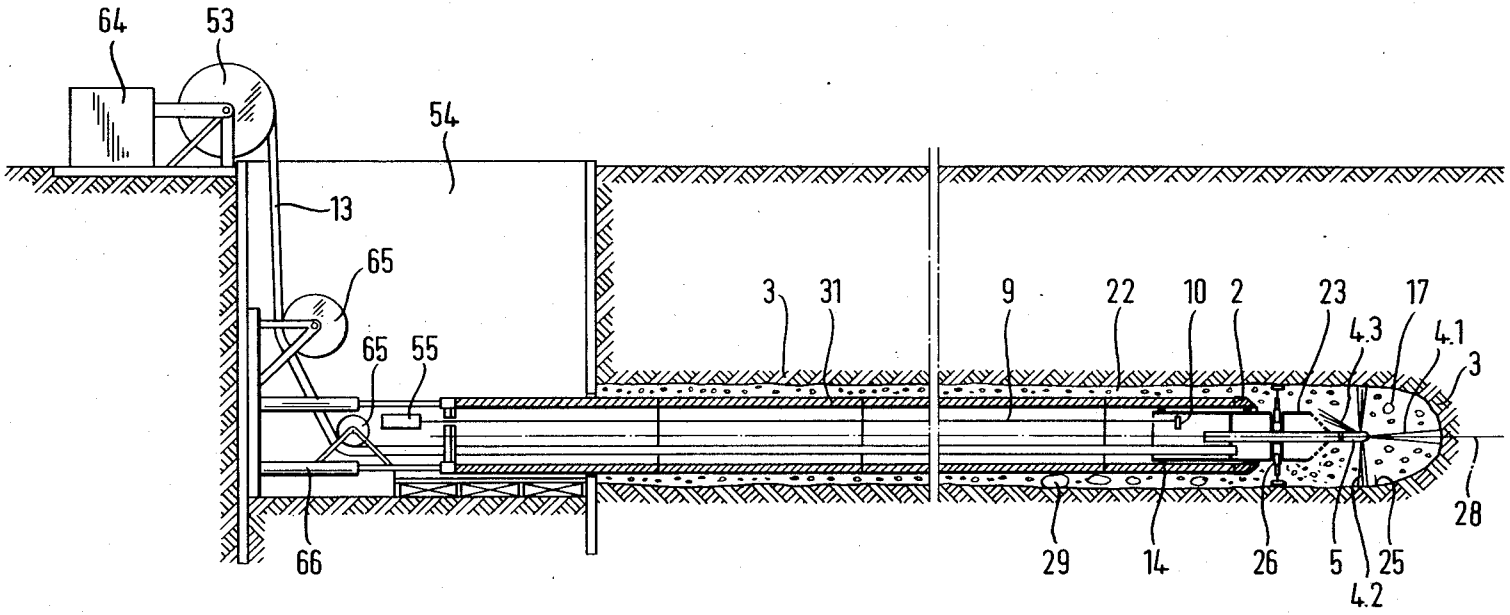
FIG. 9 is a section through a driving installation and a driven pipeline, with diagrammatic representation of a direction control for the pipeline.

Jets 43 of the nozzle body 5 are arranged in the example of embodiment in such a way that one jet 4.1 is directed forwards in the pipe axis 28 and loosens the earth, at least one jet 4.2 runs radially, and at least one jet 4.3 is directed against the receiving sieve 6 and facilitates the passage of the excess earth-liquid suspension 17 into the internal ante-chamber 32 of the machine unit 23 by sweeping across the receiving sieve. The guide rod 7, and therefore the nozzle head 5, can be moved back and forth axially by means of the drive 8. The guide rod 7 and the motor drive 8 are arranged coaxially in the machine unit 23. The supplying of the drive units with power, liquid, additives, and pressure takes place via suitable supply lines 13 which run through the pipeline 31 to an access shaft 54 (FIG. 9), and are connected to supply units 64 outside the shaft. As FIG. 9 shows, the position measurement of the pipe 31 is carried out, for example, by a coordinate determination of the point at which a laser beam 9 strikes an electronic detector surface 10. The position of the pipe 31 is controlled by movable distance spacers 11 (FIG. 1) which are swivel-mounted on the outside of the machine unit 23 in recesses 26' adjacent to the receiving sieve 6. The distance spacers 11 are swivelled radially inwards and outwards into the appropriate position by means of piston-cylinder units 16, which are housed in the ante-chamber 32 of the machine unit 23, until they lie against the ground 3 (FIG. 1). In this way, the machine unit 23 can be positioned in the earth-liquid suspension 17.

The machine unit 23 is clamped in a releasable fashion in the front part of the pipe 31 in the first two or three pipe sections 1, 1.1 by means of clamps 70, which are located on the outside of the machine unit 23 and are radially adjustable against the inner side of the pipe sections. Between the machine unit 23 and the inner wall of the pipe 31 there remains an annular space which is sealed off with sealing means 14, preferably with hollow sealing hoses, against the penetration of the earth-liquid suspension 17. After releasing the clamps 70, opening the sealing hoses 14, and retracting the distance spacers 11, the machine 23 can be brought back on runners 15 or wheels to the access shaft 54.

The pipe 31 introduced by the driving method, and comprising the pipe sections 1, has a rigidly fixed cutting ring 2 solely at the head of the first pipe section 1. Depending on the soil conditions, the cutting ring 2 can be dispensed with, so that the pipe 31 is driven into the ground 3 with the foremost section 1.1. The nozzles or jets 43 are positioned in such a way that the effective area of the approximately radially directed jets 4.2 is greater than the external diameter of the pipe 31. In this way, there remains between the pipe 31 and the solid ground 3 an annular space 22 in which the displaced earth-liquid suspension 17 is either compressed with a liquid jet 4, or solidifies, by adding a binding agent into the jetted liquid, into a solid structure 21.1, 21.2 which acquires at least the strength of the solid ground 3. If the cutting ring 2 has a slightly larger external diameter than the pipe 31, a separating layer 20 is formed between the pipe and the structure 21.1, 21.2. As a result of the separating layer 20, the pipe 31 is able to slide between the solidified annular-spaced filling 21.1, 21.2. The solidified annular-space filling also provides additional positional stability of the pipe sections 1 subsequently pushed through.

Figure 2:
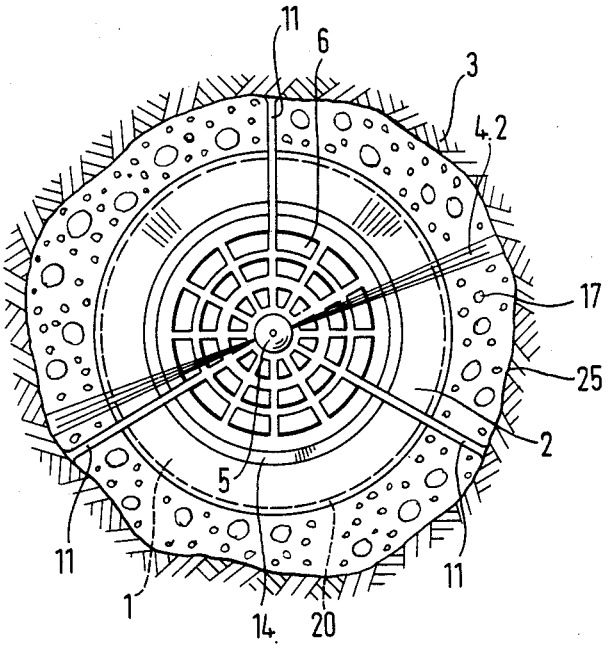
FIG. 2 is a cross section and partial view of a cylindrical in the front working area.

As FIG. 2 shows, the pipe sections 1 float in the earth-liquid suspension 17 that fills the annular space 22 between the solid ground 3 and the separating layer 20 on the outer wall of the pipe section 1. The pipe 31 is positioned by at least three of the distance spacers 11, which keep the pipe in the correct position via the machine unit 23. The sealing means 14 prevents penetration of the earth-liquid suspension 17 into the intermediate space between the machine unit 23 and the pipe section 1. The fine-grained constituents 19 of the earth-liquid suspension 17 are forced via the receiving sieve into the internal ante-chamber 32 of the machine unit 23.

FIGS. 1 and 2 show that the dimensional accuracy with which the boundary 25 of the suspension 17 is cut out from the solid ground 3 is unimportant, since only that much of the earth-liquid suspension is removed as is actually in excess. Moreover, by adding binding agents and/or additives, the earth-liquid suspension 17 remaining in the annular space 22 solidifies, with this solidification imparting additional static certainty to the pipeline 31.

FIG. 3 shows another form of embodiment of a positional support of the machine unit 23. Telescopic hydraulic rams 26 support the machine unit 23 by means of runner-shaped support plates 27 against the edge 25 of the ground 3. The hydraulic rams 26 are housed in recesses **26*a'* of the machine unit 23 in such a way that the support plates 27 are disposed within the recesses when the hydraulic rams are in their retracted position (solid lines in FIG. 3). This ensures that the machine unit 23 can be brought back through the pipe 31 if need be. The recesses 26*a'* extend radially inwardly to a protective pipe 41 arranged concentrically in the machine unit 23, the recesses being attached to the protective pipe, which surrounds the guide rod 7 for the nozzle head 5. The hydraulic rams 26, like the piston-cylinder units 16 (FIG. 1), are connected to a regulating and control device 36 (FIGS. 4 and 5) which receives information from the position measurement of the pipe 31** and processes it, by means of an actual-desired comparison, into control signals. The hydraulic rams 26 and the piston cylinder units 16 can thus be easily adjusted until they lie against the solid ground 3 and support the machine unit 23 securely. The fine-grained earth-liquid mixture 17 which penetrates through the orifices of the receiving sieve 6 is conveyed in the region between the radially arranged telescopic hydraulic rams 26 to the sluice, from where it is fed via suitable devices, which will be explained in greater detail below, to the removal pipe 12. As in the previous form of embodiment, the receiving sieve 6 comprises a largely conical base plate, preferably of steel, and a connecting cylinder, which are arranged concentrically to the pipe axis 28 and are provided with grid-like openings of any cross section and which allow all granular particles smaller than about 30 to 40 mm to pass into the internal ante-chamber 32 of the machine unit 23. A variant of this embodiment consists of slide-rule-like elements 89 (FIG. 3C) which run radially outwards from the pipe axis 28 and lie on a cone-shaped shell and/or are arranged on a cylindrical sleeve, with the pipe axis as the cylinder-axis.

Figure 4:
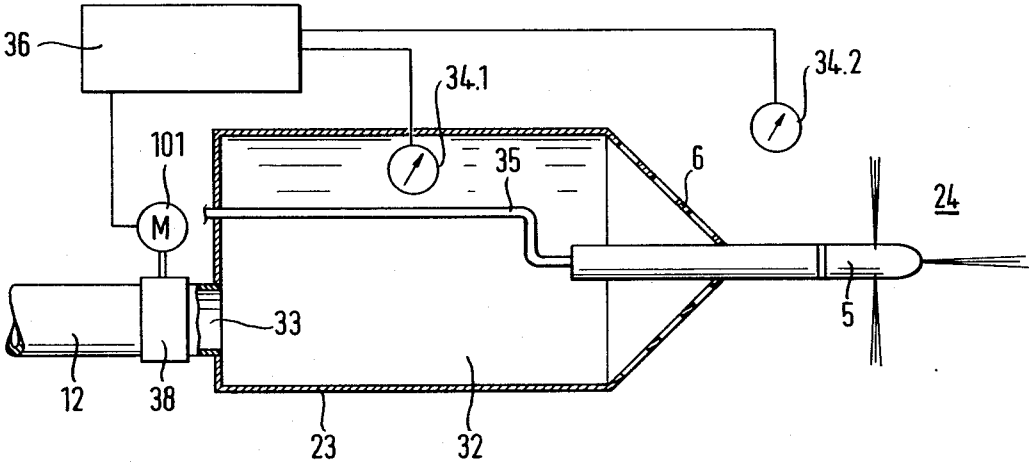
FIG. 4 is a diagrammatic representation of the control of the quantity removed, with a closure mechanism and a pressure measuring device.
Figure 5:
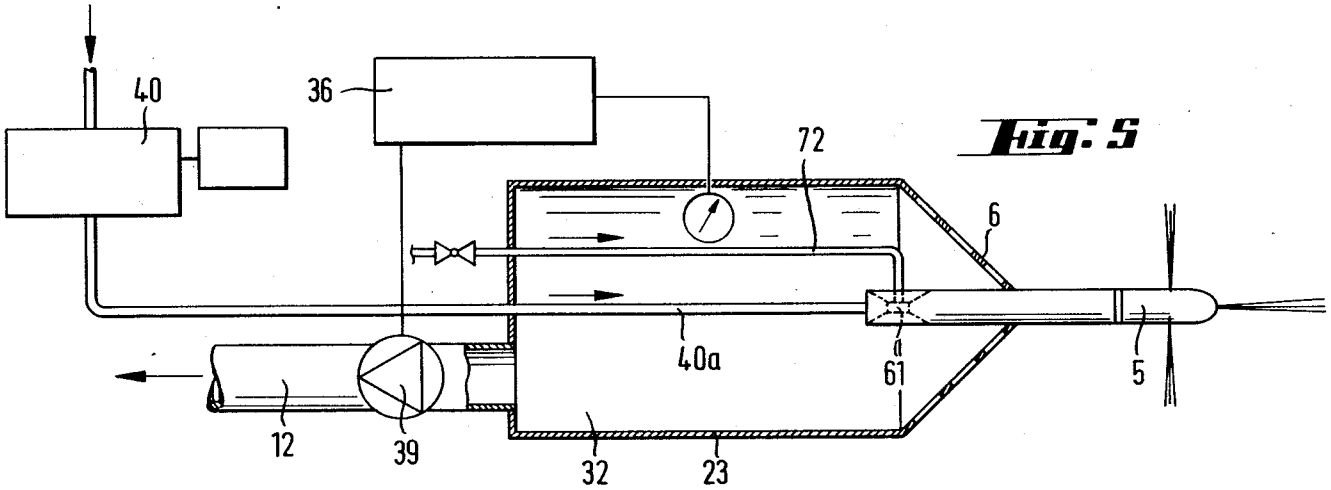
FIG. 5 is a diagrammatic representation of the control of the quantity removed, with a pumping unit and a pressure measuring device.

The possibility of controlling the quantity removed is represented in FIGS. 4 and 5. In order to support the driving face 30 (FIG. 1) and to avoid water drainage, only so much of the earth-liquid suspension is to be removed at any given time from the internal ante-chamber 32 of the machine unit 23, such that a continuous counterpressure on the driving face 30 is retained. To achieve this, a pressure detector 34.1 is installed in the internal ante-chamber 32 of the machine unit 23, said pressure detector transmitting the pressure prevailing there to the control and regulating device 36 which actuates, via a control drive, a closure element 38 by means of which the passage area of the removal pipe 12 can be adjusted. Only so much material should be delivered into the removal pipe 12, such that the specified pressure in the internal ante-chamber 32 is maintained. In order to control the permeability of the receiving sieve 6, a further pressure-sensing device 34.2, connected to the device 36, can be installed in the removal zone 24 (FIG. 1) in front of the driving face 30, and the fall in pressure between the removal zone 24 and the internal ante-chamber 32 can be compared. If need be, the closure element 38 is then adjusted.

Figure 4A:
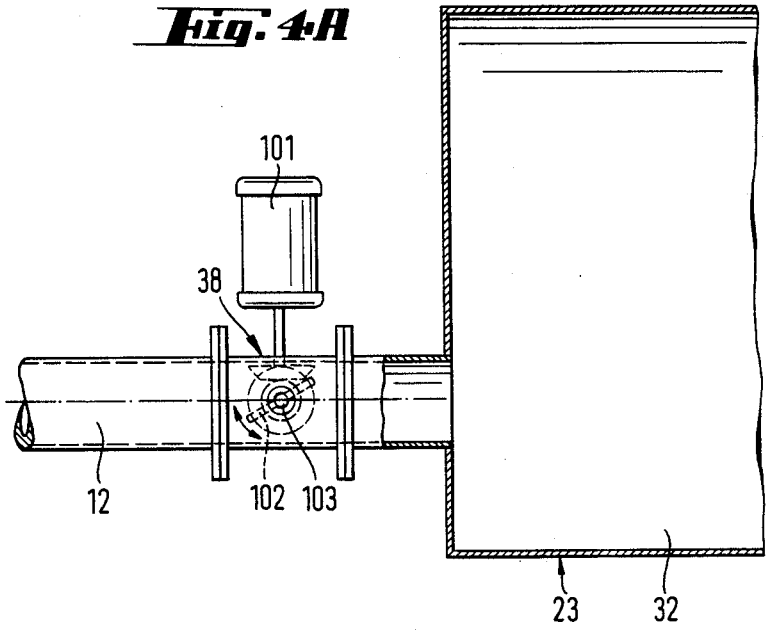
FIG. 4A is an enlarged representation of the closure mechanism according to FIG. 4.
Figure 4B:
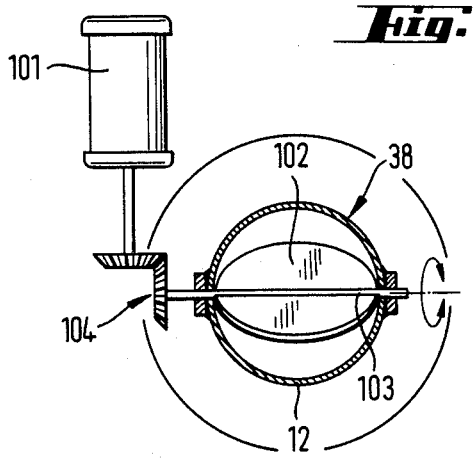
FIG. 4B is a front view of the closure mechanism according to FIG. 4A.

As FIGS. 4A and 4B show, the closure element 38 has a shutoff disk 102 mounted rotatably on a shaft 103, by means of which the passage area of the removal pipe 12 can be changed and closed. The shaft 103 crosses the removal pipe 12 and is connected to a drive motor 101 via a gear unit 104. The shaft 103, and therefore the shutoff disk 102, can be rotated by the desired amount by means of said drive motor 101.

FIG. 5 shows a variant of the control for the removed quantity of earth-liquid suspension by means of a pump 39. It is housed in the removal pipe 12 in place of the closure element 38. The pumped quantity is controlled by the control and regulating device 36 in such a way that the pressure in the internal ante-chamber 32 and in the removal zone 24 remains constant.

Furthermore, the possibility of feeding fine-grained materials, such as for example quartz sand and/or binding agents, is provided in the form of a water jet nozzle 61 which is housed in the machine unit 23. A high pressure pump 40 is connected by a pipe **40*a* to the water jet nozzle 61, which is in turn connected to the nozzle head 5. The high pressure pump 40 generates the necessary pressure for the liquid jet, in this embodiment a water jet, which is introduced in a conical narrowing of the water jet nozzle 61 in the direction towards the nozzle head 5, and which entrains the additives, such as for example quartz and/or binding agent, which are fed through a pipe 72 to the water jet nozzle. Especially when obstructions cross or are in the way of the pipe route, such as for example old piles, foundation components, large boulders, and the like, these must be cut out. In order to raise the cutting efficiency of the high pressure jet 4**, fine-grained quartz sand or similar material can also be jetted out.

Figure 6:
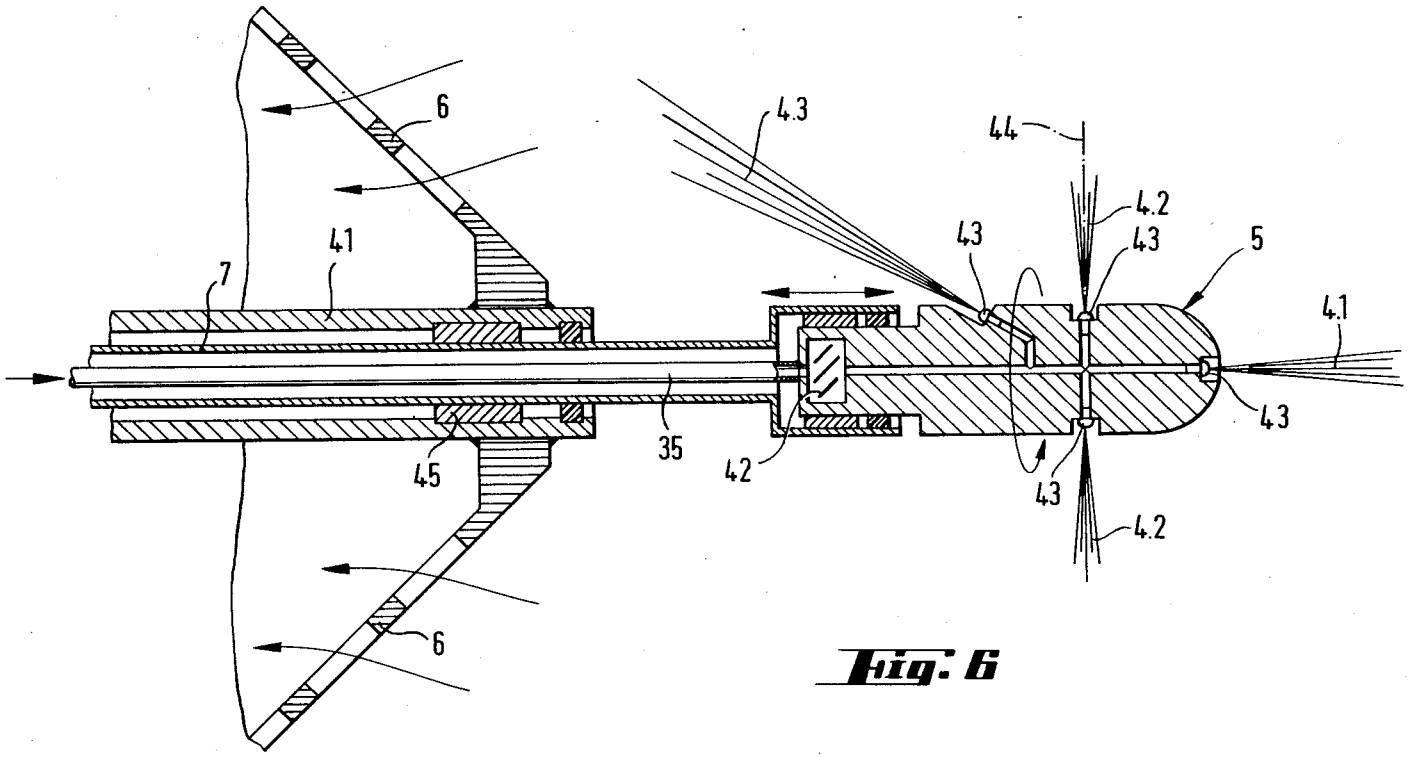
FIG. 6 is a section through a nozzle head guide and a nozzle head of the apparatus according to the invention.

FIG. 6 shows the guide and the drive of the rotating nozzle head 5. The protective pipe 41 is rigidly attached to the receiving sieve 6 in the axis 28 of the motor unit 23. Inside the protective pipe 41, the guide rod 7 of the nozzle head is arranged so as to be movable in the axial direction. In the example of embodiment two sliding bearings arranged at a distance one behind the other, at least one sealed sliding bearing 45 serves to center the guide rod 7 in the protective pipe 41. A high pressure line 35 runs inside the guide rod 7 for supplying the nozzle head 5 with the required liquid for jetting. The nozzle head 5 has a rotatable part which is connected via a slide ring packing and a bearing to a non-rotatable part. The high pressure liquid fed through the high pressure line 35 flows, upon entry into the rotatable part of the nozzle head 5, onto paddle-wheel-like components 42, by means of which the nozzle head part is driven rotatably. The nozzles or jets 43, through which the liquid jet 4 is delivered, are fitted on the rotating part of the nozzle head 5. The main jet direction 44 is at right angles to the axis 28 of the pipe 31. The jet 4.1, which is directed towards the receiving sieve, facilitates the passage of the fine-grained components of the earth-liquid suspension 17 and serves to clean the entry orifices when there is a risk of blockage. A further effect of the rearwardly directed jet 4.1 is the possible compression or compaction of the earth-liquid suspension 17 concentrated in the annular space 22 (FIG. 1) between the machine unit 23 and the ground 3 so as to enhance stability.

Figure 7:
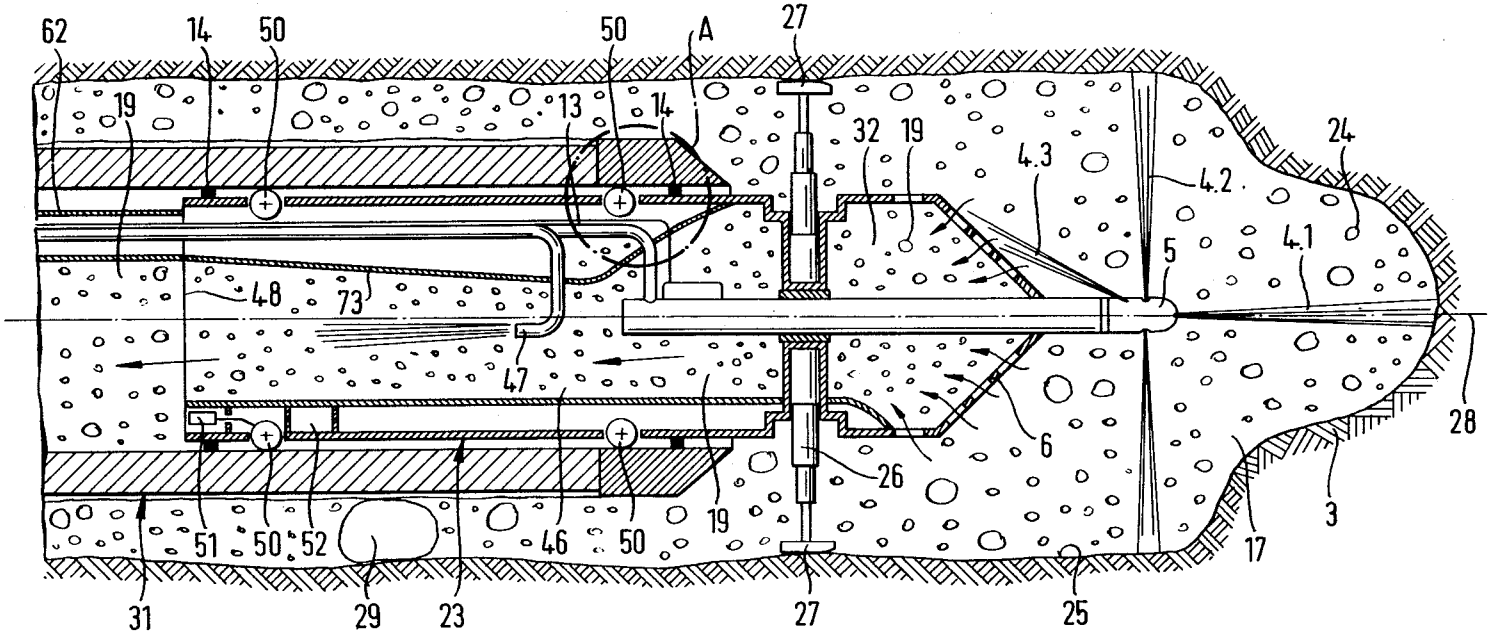
FIG. 7 is a representation in conformity to FIG. 1 of a further embodiment of an apparatus according to the invention.

FIG. 7 shows a machine unit 23 which can travel in the pipe 31. In this exemplary embodiment, the pipe 31 itself is used as a conveyer pipe for the waste or removed material. The control of the quantity removed takes place via a conical narrowing 73 in the machine unit 23, which forms a sluice 46, and by means of a water jet nozzle 47 arranged there, which is also controlled by a pressure recording in the internal ante-chamber 32 of the machine unit 23 or in the removal zone 24, as was explained with the aid of FIGS. 4 and 5. The water Jet nozzle 47 is directed backwards when viewed in the driving direction of the pipe 31, i.e. in the direction in which the waste is transported. The earth-liquid suspension along with the fine-grained soil constituents 19, entering into the machine unit through the receiving sieve 6 is entrained by the water Jet coming out of the water jet nozzle 47. The machine unit 23 is supported relative to the ground 3 by means of the hydraulic rams 26 and the support plates 27.

The waste can also be conveyed through the pipe 31 by centrifugal pumps or piston pumps, or by suction devices.

The supply lines 13 are installed in protective pipe 62 in the pipe 31, said protection pipe extending to the machine unit 23. The machine unit 23 is supported against the inner wall of the pipe 31 with wheels 50 which are each pressed by a pressure mechanism 51 against the inner wall of the pipe 31. At least one wheel 50 is driven by a motor 52 housed in the machine unit 23, so that the machine unit can be returned with its own drive to the access shaft 54.

Figure 8:
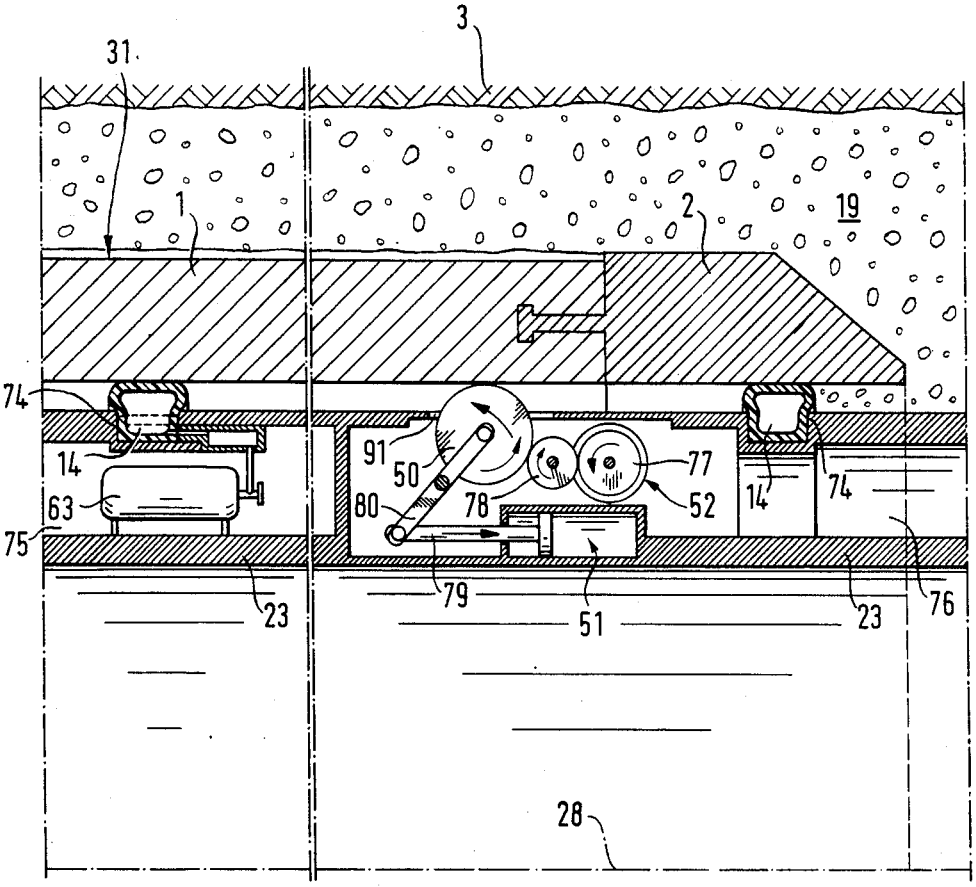
FIG. 8. is an enlarged representation of the detail "A" in FIG. 7.

The machine unit 23 is sealed relative to the inner wall of the pipe section 1 and the cutting shoe or cutting ring 2 by means of the inflatable sealing hoses 14, which are housed in the outside recesses 74 of the machine unit 23 (FIG. 8). When the machine unit 23 has taken up its position at the head of the pipe 31, it is clamped with the clamping devices 70, not shown here (FIG. 1), in the pipe, in order that longitudinal forces and moments can be transferred. The sealing units 14 are then inflated by a compressor 63 housed in a separate chamber 75 in the machine unit 23. If the machine unit 23 is to be brought back, the sealing units 14 are relieved and the clamping devices 70 and the distance spacers 11 or 26 are retracted. The motor 52 is housed in a further chamber 76 of the machine unit 23, and has a drive gear 77 which drives the corresponding wheel 50 via an intermediate gear 78. The pressure mechanism 51 is a piston-cylinder unit, the piston rod 79 of which is hinged to one end of a two-armed lever 80. The other end of the lever 80 carries the wheel 50. If the piston rod 79 is retracted, the wheel 50 is moved outwards via the lever 80, which is swivel-mounted on the machine unit, and is pressed against the inner wall of the pipe 31. The wheel 50 projects from the chamber 76 through an opening 91. The described drive 52, 77, 78, and the pressure mechanism 51, are so designed that the wheel 50 and/or the lever 80, when moved radially, permit the axial movement which occurs as a result of the swivel mounting of the lever.

The supply lines 13 are either run outside the access shaft 54 and wound on drums 53 at the earth's surface (FIG. 9), or they are wound on drums 53 in the machine unit 23.

FIG. 9 shows a diagrammatic overview of the entire driving installation, The access shaft 54 houses a power press 66 which drives the pipe section 1 into the ground 3. At the head of the driving line, the machine unit 23 is clamped against the inner wall of the pipe 31 in the described manner, and loosens the earth. The machine unit 23 is connected by the supply lines 13 to supply and drive units 64 which are located outside the access shaft 54. The connection is in the form of flexible tubes which, when the machine unit 23 moves forward or backward, are wound via guide rollers 65 in the access shaft 54 from the drum 53 or onto it, said drum having a corresponding concentric connection to the supply and drive units 64, When the pipe 31 is run in a straight line without curves, the position determination can be carried out with the laser beam 9, which is emitted from the transmitter 55 set up in the access shaft 54, and with the detector 10.

Figure 10:
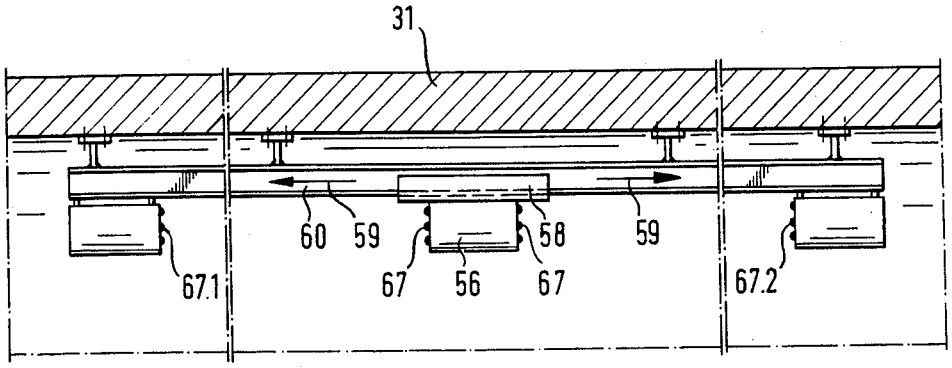
FIG. 10 is a section through a pipe with a traversable navigation device on a rail-like guide.
Figure 11:
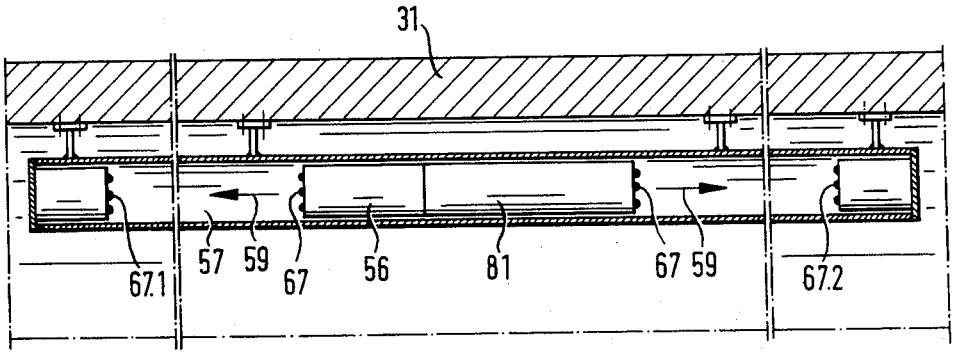
FIG. 11 is a section through a pipe with a traversable navigation device in a pipe.

A further possibility for determining the position of the pipe 31 for the steerable driving of impassable pipelines having a curved axis is shown in FIGS. 10 and 11. The absolute position coordinates of the machine unit 23 are established by means of a known navigation device 56 which is moved back and forth on a rail 60 mounted rigidly on the inner wall of the pipe (FIG. 10), or in a pipe 57 (FIG. 11), between the access shaft 54 and the machine unit. The navigation device 56 is provided with a device (not shown) for changing the direction of travel. The navigation device 56 comprises three gyroscopic systems and three longitudinal acceleration measurement units which detect all rotational and translational movements in a spacially three-dimensional coordinate system. In order to increase the measurement accuracy, the navigation system known heretofore must be moved at relatively high speed. In FIG. 10, the navigation device 56 is attached to a power-driven rail carriage 58 which moves along the rail 60 in the direction of the arrows 59 at relatively high speed. In both the access shaft 54 and in the machine unit 23, the position data is relayed via suitable contacts 67, 67.1, 67.2 to a measurement value detection and evaluation unit. FIG. 11 shows the incorporation and motion of the navigation device 56 in sort of pneumatic tubular post or tube, whereby a cylindrical container 81, in which the navigation device is installed, is moved by compressed air in the pipe 57.

Figure 12:
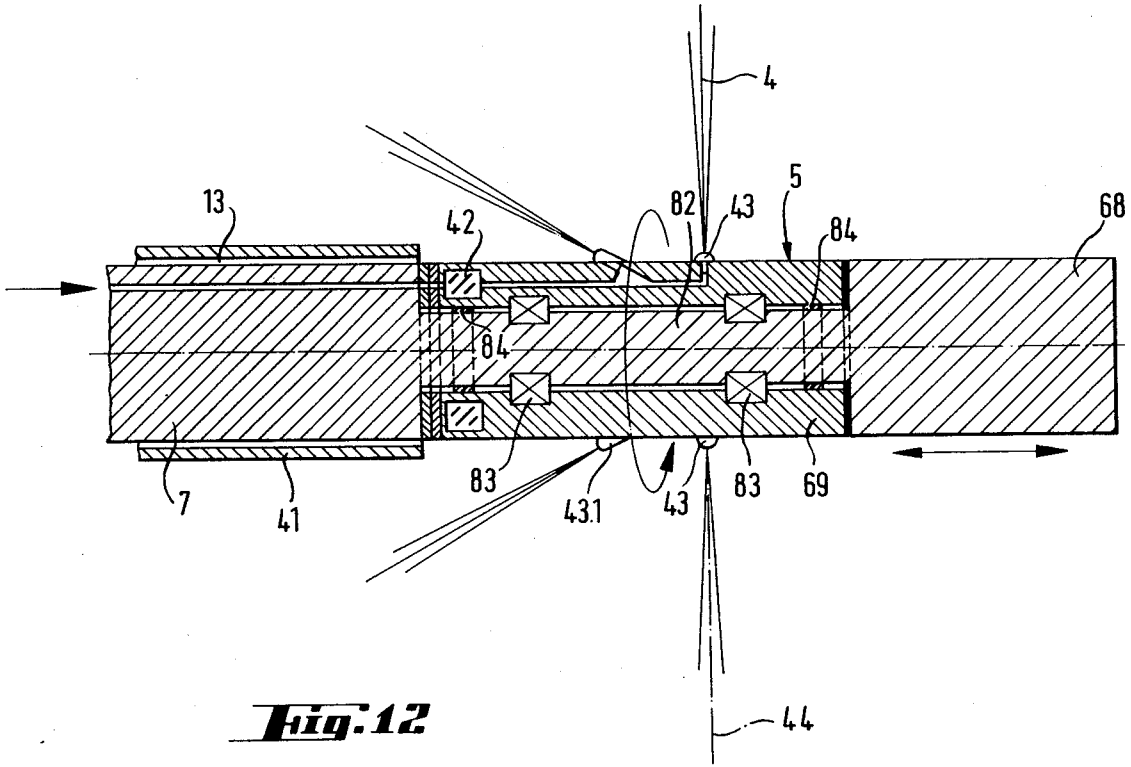
FIG. 12 is a section through a nozzle head with a hammer-like shape at the tip, and with a rotatable nozzle head.

FIG. 12 shows a variant of the nozzle head design which is especially suitable for small pipe outer and inner diameters. The nozzle head 5, which is attached to the guide rod 7, which can be moved back and forth in the protective pipe 41, has at the end a hammer-head shaped part 68 with which the exposed earth 3 or obstructions 29 can be struck directly. Between the guide rod 7 and the hammer head 68, a nozzle carrier 69 is pivoted or rotatably journalled with bearings 83 and rotates on a part 82 of the nozzle head 5 reduced in diameter. The nozzle carrier 69 is driven by liquid-jet energy, and is sealed with packings 84 relative to the remaining nozzle head section. The liquid fed through the supply lines 13 strikes the turbine-wheel-like components 42 arranged in the nozzle carrier 69, with these components 42 eftecting the rotation of the nozzle carrier 69 by jet deflection. The liquid is delivered from the supply line 13 under high pressure, and is ejected or discharged at the nozzles or jets 43, 43.1. The entire nozzle head 5 can be driven in the axial direction via the guide rod 7 by a positively driven striking mechanism (not shown). The hammer-like blows reduce the binding forces of the earth and rock structure, and force the earth components sideways. The liquid Jets 4 loosen the ground 3 in the described manner, which is then conveyed backwards.

Figure 13:
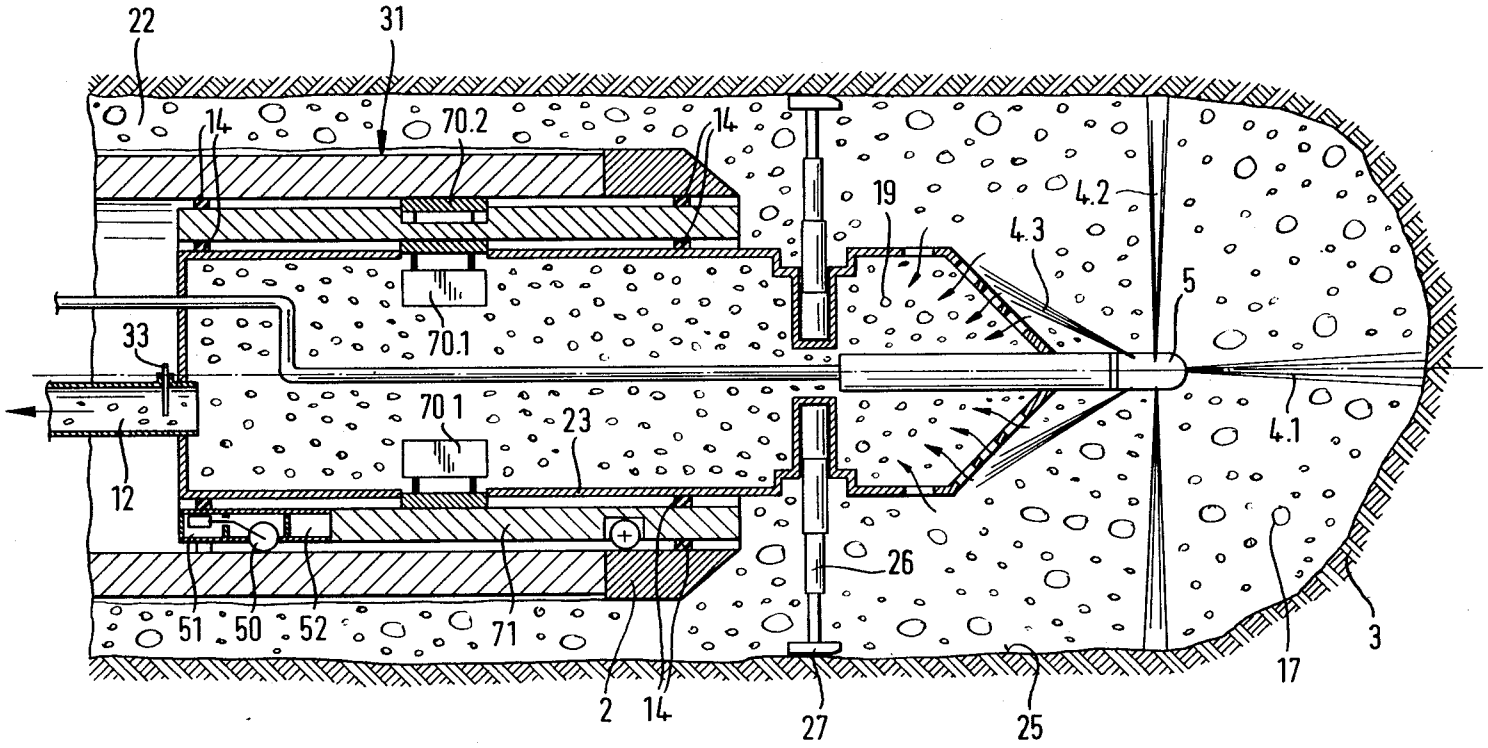
FIG. 13 is a section through an adapter for adapting the machine unit to a larger internal diameter of the pipe.

In order that the machine unit 23 may also be used for larger pipe internal diameters, an adapter 71 in the form of a cylindrical circular ring component is provided in the exemplary embodiment according to FIG. 13. The internal diameter of the adapter 71 is adapted with a fixed tolerance to the external diameter of the machine unit 23, and the external diameter of the adapter is similarly adapted to the internal diameter of the pipe 31. The machine unit 23 is supported against the inner wall of the adapter 71, and is clamped therein by the clamping devices 70.1. The adapter 71 has runners or wheels 50, and is brought back to the access shaft 54 by a cable, or is moved automatically with a gear drive 52. The adapter 71 is sealed with the sealing devices 14, which are preferably inflatable sealing hoses, relative to the inner wall of the pipe 31 and the machine unit 23, and is clamped to the inner wall of the pipe 31 by clamping devices 70.2 so as to be capable of transferring longitudinal forces and moments.

The present invention is, of course, in no way restricted to the specific disclosure of the specification and drawings, but also encompasses any modifications within the scope of the appended claims.

What I claim is:

1. A method for the underground installation of pipelines, comprising the steps of driving pipe sections with an outer diameter into solid ground, loosening the earth in the ground at the driving face by breaking it up, pulverizing it, or boring it exclusively by means of liquid jet means having an effective working diameter that is greater than the outer diameter of the pipe sections being driven into the ground while liquid is discharged from a nozzle head of the jet means at high pressure and high speed, and transporting the excess earth backwards, from a removal zone disposed between said driving face and a removal device, through said pipeline for removal or treatment; the improvement therewith comprising the steps of:

forming, in said loosening step, an earth-liquid mixture of loosened earth and liquid from said jet means so that earth-liquid mixture is located in advance of direction in which said driving of pipe sections into the ground occurs;

removing only so much of said earth-liquid mixture from said removal zone such that the latter remains adjusted and progressively completely filled with earth-liquid mixture during said driving of pipe sections;

leaving an annular displacement space between pipe sections and the ground; and forcing larger earth aggregates and obstructions in the ground outwardly into the annular displacement space.

2. A method according to claim 1, which includes the steps of loosening said earth to a greater cross-sectional area than the outer diameter of said pipeline; permitting earth-liquid mixture to remain in the region between said pipeline and the ground; and adding to said liquid jet means such an amount of solidifying agent that, after hardening, said earth-liquid mixture in said region between said pipeline and said ground has at least the same bearing capacity as does the solid ground.

3. A method according to claim 1, which includes the step of controlling the quantity of earth-liquid mixture removed from said removal zone as a function of pressure measurement.

4. A method according to claim 1, which includes the step of conveying only said earth-liquid mixture through said pipeline.

5. A method according to claim 1, which includes the step of positioning said driven pipeline as distance-controlled with respect to support at the boundary of unloosened earth.

6. A method according to claim 1, which includes the step of adding fine-grained hard additives, of the quartz sand type, to said liquid jet means in order to improve the cutting or boring effect of the latter.

7. A method according to claim 1, which includes the step of using the compressive force of at least one liquid jet from said nozzle head to strengthen the region between said pipeline and the solid ground.

8. A method according to claim 1, which includes the step of exerting a striking and displacing effect on said driving face by means of an alternate back and forth movement of said nozzle head in the longitudinal direction of said pipeline.

9. A method according to claim 1, which includes the steps of providing at least one navigation device for positional control of said pipeline which is to be driven, and moving said navigation device back and forth along a guide between the head of said pipeline and an access shaft.

10. An apparatus for the underground installation of pipelines, including at least one driving unit for driving said pipeline into the ground, and a machine unit which is traversable in said pipeline and has at least one nozzle head which, for loosening the ground at the driving face, is provided with liquid jet means which form an earth-liquid mixture comprised of loosened earth and liquid from said jet means; said machine unit is connected by piping to supply and removal units and by cables to control devices, and has at least one removal pipe for conveying away earth-liquid mixture; the improvement comprises:

an attachment device which is at least partially disposed in said machine unit, and connects the latter to said at least one nozzle head;

an internal ante-chamber provided in said machine unit;

a receiving device disposed on said machine unit and located behind said at least one nozzle head away from said driving face; said receiving device is provided with entry orifices for earth-liquid mixture, and communicates with said ante-chamber so that earth-liquid mixture can be received by the latter; and a sluice provided in said machine unit for passing earth-liquid mixture from said ante-chamber into said removal pipe in a controlled manner.

11. An apparatus according to claim 10, in which said attachment device for said at least one nozzle head is a guide rod.

12. An apparatus according to claim 10, in which said at least one nozzle head is connected to a high pressure pump via a high pressure line; in which said nozzle head is rotatably connected to said attachment device; and in which said nozzle head is provided with rotary drive means disposed in the supply path of liquid to said liquid jet means.

13. An apparatus according to claim 10, in which said at least one nozzle head includes at least one high pressure jet having an adjustable spray direction and being adapted to be directed against said receiving device.

14. An apparatus according to claim 10, in which said receiving device includes a conical sieve part which is provided with said entry orifices.

15. An apparatus according to claim 14, in which said sieve part of said receiving device comprises a dome-shaped steel plate having entry orifices of any desired shape.

16. An apparatus according to claim 14, in which said sieve part of said receiving device is a rod lattice.

17. An apparatus according to claim 10, which includes at least one pressure measuring device disposed in said internal ante-chamber of said machine unit; and which includes a regulating and control device connected to said pressure measuring device and to said sluice for control of the latter.

18. An apparatus according to claim 17, in which said sluice is a driven shutoff device.

19. An apparatus according to claim 17, in which said sluice is a regulatable pump unit.

20. An apparatus according to claim 17, in which said sluice is formed by a conical narrowing of the cross section in said machine unit; and which includes in the middle of said conical narrowing a water jet nozzle for promoting transport of earth-liquid mixture in the direction away from said driving face.

21. An apparatus according to claim 10, which includes a pump unit in said sluice for exerting a suction effect for promoting transport of earth-liquid mixture in the direction away from said driving face.

22. An apparatus according to claim 10, in which said machine unit is provided with travel means, so that it can travel in said pipeline; at least one pressure mechanism is provided for pressing said travel means against the inner wall of said pipeline; so as to transfer longitudinal forces and moments; and at least one clamping device is provided for locking said machine unit in a given position in said pipeline so as to transfer longitudinal forces and moments.

23. An apparatus according to claim 22, in which said machine unit is provided with a self-contained drive.

24. An apparatus according to claim 10, which includes sealing means annularly disposed on the outer surface of said machine unit to seal the latter relative to the inner wall of said pipeline.

25. An apparatus according to claim 10, in which said piping includes flexible supply lines which can be wound upon drums provided in one of: said machine unit, an access shaft, and externally of the latter.

26. An apparatus according to claim 10, which includes support means disposed on the outside of said machine unit, in the vicinity of said driving face, for the purpose of positioning said pipeline in the ground.

27. An apparatus according to claim 26, in which said support means includes rods which are pivotably connected to said machine unit, and piston-cylinder units for respective adjustment of said rods.

28. An apparatus according to claim 26, in which said support means includes hydraulic rams, one end of each of which is connected to said machine unit, with the other end being provided with a support element for placement against the ground.

29. An apparatus according to claim 26, in which said support means are connected to a regulating and control unit.

30. An apparatus according to claim 10, which includes, for measuring the position of said pipeline, at least one laser beam-transmitting device in an access shaft, and an electronic target detector on said machine unit for said laser beam.

31. An apparatus according to claim 10, which includes guide means in said pipeline, and at least one navigation device which travels along said guide means; said navigation device is provided with three rotational and three linear accelerometers, and relays the position coordinates at any given time to a control and regulating unit.

32. An apparatus according to claim 31, in which said navigation device is housed in a cylindrical container; and in which said guide means is a pipe in which said container is movable by means of compressed air.

33. An apparatus according to claim 31, in which said guide means is a rail; and in which said navigation device is provided with a self-contained drive mechanism so that it can travel on said rail.

34. An apparatus according to claim 10, in which said nozzle head is in the form of a striking tool.

35. An apparatus according to claim 34, which includes at least one motor drive for moving said attachment device back and forth in the direction of the central longitudinal axis of said pipeline.

36. An apparatus according to claim 35, which includes, for adaptation to larger internal diameters of said pipeline, a cylindrical adapter which is attachable to said machine unit and has travel means which rest against the inner wall of said pipeline so that said adapter, and hence said machine unit, can travel in said pipeline.

37. An apparatus according to claim 36, in which said adapter is provided with at least one clamping mechanism for locking said adapter in position against the inner wall of said pipeline; and in which sealing means are provided for sealing off the space between said adapter and said pipeline.

* * * * *